US010612396B2

(12) United States Patent
Vassiliev et al.

(10) Patent No.: US 10,612,396 B2
(45) Date of Patent: Apr. 7, 2020

(54) MECHANICAL COMPONENT

(71) Applicant: General Electric Technology GmbH, Baden (CH)

(72) Inventors: Vladimir Vassiliev, Baden (CH); Peter Vitalievich Laletine, Moscow (RU); Alexey Mozharov, Baden (CH); Andrey Sedlov, Baden (CH)

(73) Assignee: General Electric Technology GmbH, Baden (CH)

( * ) Notice: Subject to any disclaimer, the term of this patent is extended or adjusted under 35 U.S.C. 154(b) by 254 days.

(21) Appl. No.: 16/006,921

(22) Filed: Jun. 13, 2018

(65) Prior Publication Data

US 2019/0010808 A1 Jan. 10, 2019

(30) Foreign Application Priority Data

Jul. 5, 2017 (EP) ..... 17179727

(51) Int. Cl.
*F01D 5/18* (2006.01)

(52) U.S. Cl.
CPC ..... *F01D 5/187* (2013.01); *F05D 2240/127* (2013.01); *F05D 2240/303* (2013.01); *F05D 2250/231* (2013.01); *F05D 2260/20* (2013.01)

(58) Field of Classification Search
None
See application file for complete search history.

(56) References Cited

U.S. PATENT DOCUMENTS 7,390,168 B2 * 6/2008 Liang ..... F01D 5/186 416/97 R
7,520,723 B2 * 4/2009 Liang ..... F01D 5/187 416/97 R (Continued)

FOREIGN PATENT DOCUMENTS

| | | |
|---|---|---|
| EP | 0 899 425 A2 | 3/1999 |
| JP | S 55-040221 A | 3/1980 |
| JP | H 11-132003 A | 5/1999 |

OTHER PUBLICATIONS

Extended European Search Report and Opinion issued in connection with corresponding EP Application No. 17179727.7 dated Dec. 14, 2017.

(Continued)

*Primary Examiner* — Christopher Verdier
*Assistant Examiner* — Jason A Fountain
(74) *Attorney, Agent, or Firm* — Theodoros Stamatiadis; Hoffman Warnick LLC

(57) ABSTRACT

A mechanical component comprises an internal hollow space and a wall, the wall limiting the hollow space. The mechanical component further comprises a first channel extending inside the wall along a first direction and a second channel extending inside the wall in fluid communication with the internal hollow space and the first channel, serving as a feed channel. A cross-sectional dimension of the first channel is larger than a cross-sectional dimension of the feed channel, and the feed channel tangentially joins into the first channel. A third channel extends inside the wall in fluid communication with the first channel. The third channel extends inside the wall at least essentially parallel to a surface of the wall along at least a part of the extent of the wall in a second direction, and is a near wall cooling channel.

12 Claims, 2 Drawing Sheets

(56) References Cited

U.S. PATENT DOCUMENTS

| | | | | |
|---|---|---|---|---|
| 8,382,431 | B1 | 2/2013 | Liang | |
| 2005/0265837 | A1* | 12/2005 | Liang | F01D 5/186 416/97 R |
| 2008/0008598 | A1* | 1/2008 | Liang | F01D 5/187 416/97 R |
| 2018/0135427 | A1* | 5/2018 | Surace | F01D 5/187 |

OTHER PUBLICATIONS

Japanese Search Report for Japanese Patent Application No. 2018-120346 dated Aug. 7, 2019, 20 pgs.
Japanese Office Action for Japanese Application No. 2018-120346 dated Aug. 21, 2019, 15 pgs.
Japanese Office Action for Japanese Application No. 2018-120346 dated Oct. 17, 2019, 12 pgs.

* cited by examiner

MECHANICAL COMPONENT

TECHNICAL FIELD

The present disclosure relates to a mechanical component as set forth in claim 1. It further relates to a turboengine blading member.

BACKGROUND OF THE INVENTION

In a large variety of technical applications, mechanical components are subjected to elevated temperatures and thus require cooling of the component. Examples, while non-limiting, may be found in components provided in furnaces, in hot fluids, such as e.g. combustion gases, and in hot fluid flows. For instance, components provided in or around the combustion chamber and the hot gas path of a gas turbine engine require cooling.

Efficient use of coolant is one key factor to efficient operation of gas turbine engines, in particular, if the coolant used is working fluid bled from a compressor. A factor which influences cooling efficiency is heat exchange between the material of the component and the coolant. U.S. Pat. No. 6,932,573 discloses to this extent a cooling system in a trailing edge of a turboengine airfoil which may be referred to as cyclone cooling. A number of cyclone cooling channels are provided inside the trailing edge and extend along a spanwise direction of the airfoil. The term spanwise shall in connection with an airfoil be understood as "along the direction in which a spanwidth extends". A feed channel tangentially joins into a first cyclone channel which is disposed most upstream along the direction of a working fluid flow around the airfoil. Due to a coolant entering the cyclone channel in a tangential direction, the coolant develops a cyclone flow inside the cyclone channel and thus enhances heat transfer between the trailing edge material and the coolant. The coolant from the first cyclone channel is discharged through a channel which joins tangentially into the downstream next cyclone channel. The most downstream cyclone channel discharges the coolant at a downstream position of the trailing edge. It may be said, that a number of cyclone channels are provided in a staged manner in a streamwise direction and inside the trailing edge volume. The fluid communication between the cyclone channels is provided inside the trailing edge volume. It may thus be said that according to the teaching of U.S. Pat. No. 6,932,573 a number of cyclone cooling channels is provided within the volume of an airfoil trailing edge. The fluid communication between the cyclone cooling channels is provided through communication channels which are also provided inside the trailing edge volume. Cooling of the wall of the component is effected from the surface of the wall.

Further, efficient cooling and a minimization of temperature mismatches inside a mechanical component is important to improve the lifetime of mechanical components which are subjected to heat intake at elevated temperature levels. One factor which influences temperature mismatch is the distribution of coolant temperature at different locations of the component.

BRIEF DESCRIPTION OF THE INVENTION

A mechanical component as set forth in claim 1 is disclosed. In an aspect, the component shall be disclosed such that during operation a cooling fluid effects efficient cooling of the material of the component. In another aspect, efficient use of coolant shall be achieved.

These goals are accomplished by the subject matter described in claim 1.

Further effects and advantages of the disclosed subject matter, whether explicitly mentioned or not, will become apparent in view of the disclosure provided below.

Accordingly, disclosed is a mechanical component comprising an internal hollow space and a wall, wherein the wall limits the hollow space. In certain embodiments, at least a part of the wall may provide an outer surface of the component. The mechanical component further comprises a first channel extending inside the wall along a first direction and along at least a part of the extent of the wall in the first direction. A second channel extends inside the wall and is provided in fluid communication with the internal hollow space and the first channel. In an aspect, the second channel runs oblique and more in particular perpendicular to the first channel. A cross-sectional dimension of the first channel is larger than, and in particular embodiments at least twice as large as, a cross-sectional dimension of the feed channel. A cross sectional dimension may be a dimension measured across a channel perpendicular to the axis of a channel, or may in certain instances be a hydraulic diameter. The hydraulic diameter $D_H$ of a channel of any cross section is defined as $$D_H=4*A/P,$$

wherein A denotes the cross sectional area of a channel and P the so-called wetted perimeter. The second channel is intended to serve as and may be referred to as a feed channel, through which a coolant tangentially flows into the first channel during operation. The feed channel is arranged to tangentially join into the first channel. In that the feed channel joins tangentially into the first channel, a fluid entering the first channel through the feed channel develops a cyclone or vortex flow inside the first channel. The first channel may thus be considered as and be referred as a cyclone channel or first cyclone channel. The fluid is thus in intense contact with the material surrounding the first channel, and heat exchange between the fluid and the surrounding material is largely enhanced. The fluid may for instance be a coolant intended to cool a thermally charged component. A third channel extends inside the wall and is in fluid communication with the first channel. At least one of the second channel and/or the third channel extends inside the wall and at least essentially parallel to a surface of the wall along at least a part of the extent of the wall in a second direction, and is intended to serve as and may be referred to as a near wall cooling channel.

It is noted that within the framework of the present disclosure the use of the indefinite article "a" or "an" does in no way stipulate a singularity nor does it exclude the presence of a multitude of the named member or feature. It is thus to be read in the sense of "at least one" or "one or a multitude of".

In operation, for an instance, a coolant may be supplied to the hollow space. From the hollow space, the coolant may enter the first channel through the feed channel, and leave the first channel through the third channel, from where it may be discharged in an appropriate manner, or be further used for cooling purposes.

In an aspect, thus, also a method for cooling a thermally charged mechanical component is disclosed. A coolant is fed into a first channel provided in a wall of the component. The method further comprises inducing a cyclone or vortex flow of the coolant inside the first channel, with a cyclone axis at least essentially aligned with an axis of the first channel. Further, the method comprises at least one of feeding the coolant to the first channel through a near wall cooling channel and/or discharging the coolant from the first channel into a near wall cooling channel, wherein the near wall cooling channel extends inside the wall and at least essentially parallel to a surface of the wall along at least a part of the extent of the wall in a direction which is different from the direction in which the first channel extends.

In certain embodiments, a surface of the wall constitutes an outer surface of the component. The surface to which the near wall cooling channel extends at least essentially parallel may then be an outer surface of the component.

A length along which the near wall cooling channel extends inside the wall and at least essentially parallel to the surface of the wall may in certain embodiments be at least ten times the hydraulic diameter of the near wall cooling channel. In more specific embodiments, this length may be at least 15 times or at least 20 times the hydraulic diameter of the near wall cooling channel. Through this condition, a large relative heat exchange surface is provided for the coolant flowing through a near wall cooling channel.

In certain instances, the third channel may open out of the wall, and in more particular instances at the outer surface of the component, such that the coolant discharged from the third channel may for instance serve as film cooling fluid on the outer surface of the mechanical component. In other instances, however, a fourth channel extends inside the wall and at least essentially in the first direction in which the first channel extends. The fourth channel is provided in fluid communication with the third channel through an inlet which joins tangentially into the fourth channel. In certain embodiments, the inlet may be provided as a downstream end of the third channel. In particular, a cross sectional dimension of the fourth channel is larger than a cross sectional dimension of the inlet, and said cross sectional dimension may be at least twice, more in particular at least three times or at least four times, that of the inlet. The coolant which is discharged from the third channel and into the fourth channel is through the tangentially joining inlet forced into a loop movement inside the fourth channel, similar to that of the fluid entering the first channel. The fourth channel may thus be referred to as a second cyclone channel. In certain embodiments, a discharge channel may be provided in fluid communication with the fourth channel and opening out of the wall, and in particular opening out onto the outer surface of the component. Such, the fourth channel is in fluid communication with the exterior of the component, and fluid discharged through the discharge channel may for instance serve as film cooling fluid on the outside of the component.

The method outlined above may to this extent comprise feeding coolant from the third channel into a fourth channel, which may in particular instances extend at least essentially parallel to the first channel, and inducing a cyclone flow of coolant inside the fourth channel. In further, more specific embodiments, the method may further comprise discharging the coolant from the fourth channel to the outside of the component.

In other aspects, the inner hollow space may be open at one axial end and closed at the other axial end in its lengthwise orientation. Through the open end, a fluid, such as a coolant, may be provided, which then in turn may flow through the channels provided in the wall and may for instance effect cooling of a thermally loaded component.

The first channel may be closed at its axial ends in its lengthwise orientation, such as to force a fluid fed into the cyclone channels to exit through the third channels provided in fluid communication with the first channel for the purpose. Also, the fourth channel may be closed at its axial ends in its lengthwise orientation.

In further aspects, along a longitudinal extent of the first channel a multitude of at least two feed channels may join into the first channel and/or at least two third channels may be provided in fluid communication with the first channel. This results in a more homogeneous flow field along the longitudinal extent of the first channel, and hence results for instance in a more homogeneous cooling effect along the longitudinal extent of the first channel. The same may mutatis mutandis apply to the fourth channel, or second cyclone channel. Moreover, a multitude of near wall cooling channels results in a more homogeneous cooling of the wall in which the near wall cooling channels extend.

In still further more specific embodiments, the mechanical component may be intended and shaped with a profile to be placed in a fluid flow, and the first channel is located at least essentially at an intended position of a stagnation point. The skilled person will readily appreciate the specifics of a body intended and shaped with a profile to be placed in a fluid flow. The skilled person will generally be able to identify an intended position of a stagnation point of an aerodynamically shaped body, at least within a tolerance range comparable to the size of the first channel. The skilled person will readily appreciate that generally for instance in a hot fluid flow, the stagnation point of a body is subjected to the highest temperature, due to the conversion of kinetic energy into thermal energy. Furthermore, for aerodynamic reasons, the heat transfer between the fluid and the body may be enhanced at the stagnation point. In that the first channel is located at least essentially at an intended position of the stagnation point, a particularly good cooling may be provided at the thermally heavy loaded stagnation point position of the body.

It is appreciated, that on the surface of a spatially extended body like an airfoil a kind of stagnation line rather than a stagnation point may be present. However, the skilled person will readily appreciate and generalize the meaning of the term.

Even more specifically, the mechanical component may be one of a turboengine blading member, an airfoil, and a leading edge member of an airfoil, and may exhibit at least part of an airfoil profile, comprising a pressure side contour, a suction side contour, and a stagnation point—or stagnation line, respectively—provided therebetween, wherein the channels are provided inside a wall of the airfoil, and the first channel extends at least essentially along a spanwise direction of the airfoil. The third channel or third channels may in certain embodiments extend from the first channel and inside the wall on the pressure side contour of the airfoil profile. It may then moreover be provided that the fourth channel extends at least essentially along a spanwise direction of the airfoil, and is in fluid communication with the third channel through a tangentially joining inflow channel. In certain specific embodiments, the fourth channel may be provided inside the wall at the suction side contour of the airfoil profile, In specific exemplary embodiments, the mechanical component is a leading edge member of an airfoil, which comprises an interface for attaching the leading edge member to an airfoil body. The leading edge member may then be manufactured separately from and applying different manufacturing methods than for the manufacturing of the airfoil body. The leading edge member and the airfoil body may be comprised of different materials. For instance, the leading edge member may be manufactured applying additive manufacturing methods, wherein the leading edge member may successively be built from a powder material in melting and re-solidifying layers of powder material. Such methods are for instance known as, while not limited to, Selective Laser Melting (SLM) or Electron Beam Melting (EBM). They allow forming complex internal structures inside a component with high precision. The airfoil body may be cast or otherwise manufactured applying conventional manufacturing methods. This kind of hybrid manufacturing allows applying the economically most suitable and technically most feasible manufacturing technique for each sub-component. As a surplus benefit, in only manufacturing a part of an airfoil in applying additive manufacturing methods, smaller building chambers will be required, or a multitude of components may be simultaneously manufactured in one chamber of a given size. This saves investment expense and/or saves time, and smaller volume components to be built helps in reducing scrap rates.

To this extent, a turboengine blading member is disclosed which comprises a root, an airfoil body, and an airfoil leading edge member. The root and the airfoil body may in certain exemplary embodiments be provided integrally with each other. The airfoil leading edge member is a separately manufactured mechanical component of the type disclosed and discussed above, and is attached to the airfoil body. An open end of the inner hollow space points towards the root and is in fluid communication with an aperture in the root.

Accordingly, the skilled person will by virtue of the explanations above also appreciate the disclosure of a method for manufacturing a turboengine blading member. The skilled person will by virtue of the explanations above, and further the exemplary embodiment described below, also appreciate the disclosure of a method for cooling a mechanical component.

It is understood that the features and embodiments disclosed above may be combined with each other. It will further be appreciated that further embodiments are conceivable within the scope of the present disclosure and the claimed subject matter which are obvious and apparent to the skilled person.

BRIEF DESCRIPTION OF THE DRAWINGS

The subject matter of the present disclosure is now to be explained in more detail by means of selected exemplary embodiments shown in the accompanying drawings. The figures show FIG. 1 a cross-sectional view of a leading edge member for an airfoil as one exemplary embodiment of a mechanical component of the type disclosed above.

It is understood that the drawings are highly schematic, and details not required for instruction purposes may have been omitted for the ease of understanding and depiction. It is further understood that the drawings show only selected, illustrative embodiments, and embodiments not shown may still be well within the scope of the herein disclosed and/or claimed subject matter.

DETAILED DESCRIPTION OF THE INVENTION

Figure 1:
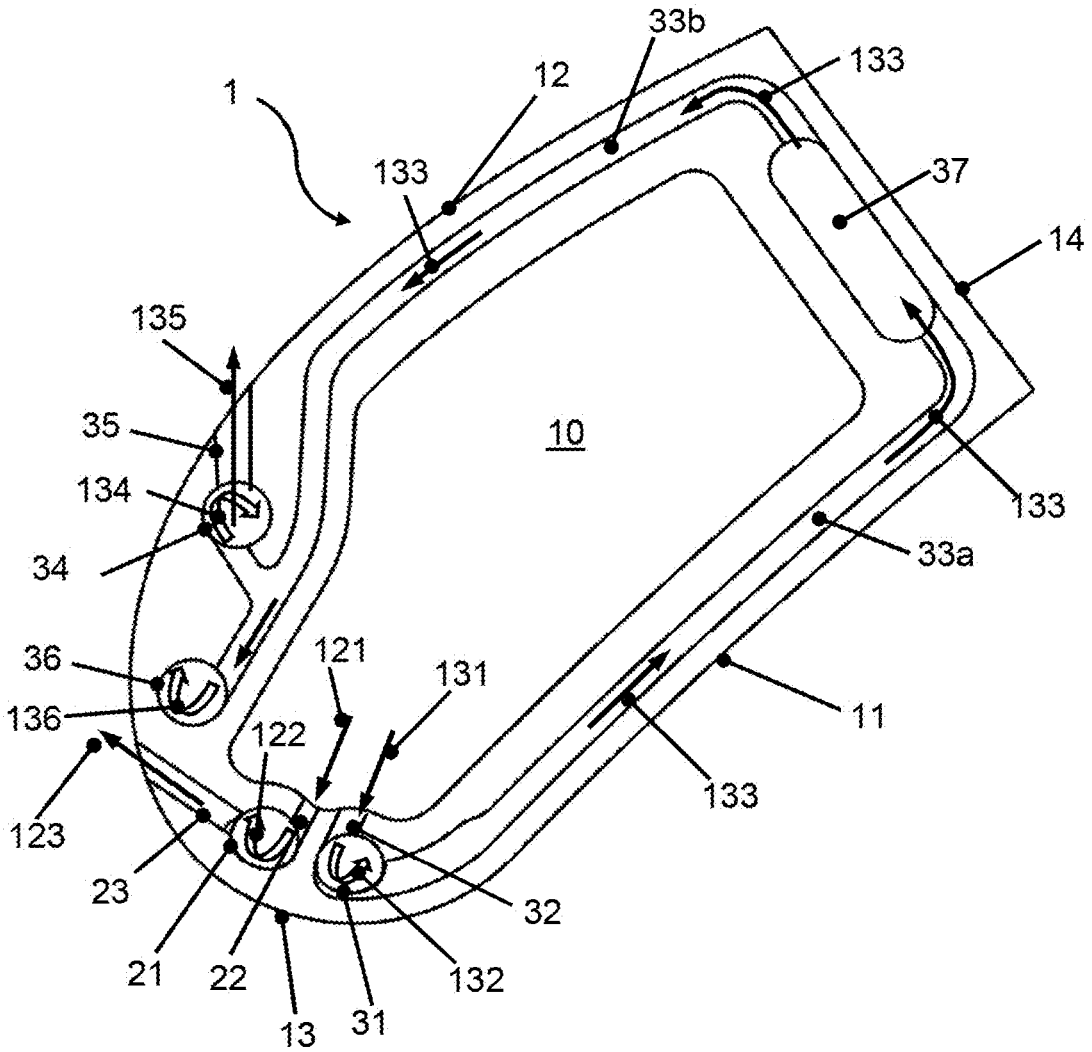

FIG. 1 depicts a cross-sectional view of a leading edge member 1 of an airfoil as an exemplary embodiment of a mechanical component of the type described above. Essentially, leading edge member 1 comprises a wall which delimits a hollow space 10. As will be appreciated by virtue of the description below, hollow space 10 serves as a coolant plenum. On an outer surface of the wall, the outer contour of leading edge member 1 exhibits an upstream stagnation point 13. In a downstream direction, the outer surface of the wall extends from the stagnation point with a pressure side surface 11 and a suction side surface 12. On a downstream side of the leading edge member 1, an interface 14 is provided on the outer surface of the wall and is intended to be connected to a blading member or airfoil body. Leading edge member 1 is intended to be used in a high-temperature fluid flow. Thus, leading edge member 1 is provided with a cooling system. In a spanwise direction of the leading edge member, which is perpendicular to the drawing plane in FIG. 1, hollow space 10 may in particular comprise one closed end and one open end. When mounted to a blading member, the closed end is provided towards the blade tip, whereas the open end is provided towards the blade root. Through the open end, hollow space, or coolant plenum, 10 may be provided in fluid communication with an aperture in the blade root. When installed in an engine, hollow space 10 may through said aperture and open end be in fluid communication with a coolant system of the engine in a manner which is familiar to the person having skill in the art. Thus, during operation of an engine in which leading edge member 1 is installed, a coolant may be supplied to hollow space 10. The cooling system further comprises an arrangement of channels inside the wall. Underneath the outer surface of the wall in the stagnation point 13 area, two channels 21 and 31 extend in the spanwise direction. Channel 21 is in fluid communication with hollow space or plenum 10 through feed channel 22. Further, discharge channel 23 is provided in fluid communication with channel 21 and opens out onto the outer surface of the wall. Feed channel 22 joins tangentially into channel 21. A coolant flow 121 which enters channel 21 through feed channel 22 thus develops a vortex or cyclone flow 122 inside channel 21. The heat transfer between the wall and vortex flow 122 inside channel 21 is significantly enhanced in that vortex flow 122 is provided. Thus, the coolant is able to very efficiently cool the material of the wall adjacent channel 21. From channel 21, the coolant is discharged onto the outer surface of the wall through discharge channel 23, as indicated at 123, where it may serve as film cooling fluid on the suction side of the airfoil. Channel 31 is in fluid communication with hollow space 10 through feed channel 32. Feed channel 32 tangentially joins into channel 31. Thus, a coolant flow 131 entering channel 31 through feed channel 32 develops a vortex or cyclone flow 132 inside channel 31. In that two cyclone channels 21 and 31 are provided inside the wall underneath the outer surface of the wall in the stagnation point area, the thermally highly loaded stagnation point area is efficiently cooled. A channel 33*a* is provided in fluid communication with channel 31 and extends inside the wall on the pressure side underneath the pressure side surface 11, and extends essentially to just short of the downstream end of the leading edge member. Channel 33*a* is at its downstream end provided in fluid communication with a channel 33*b*, which extends inside the wall underneath the suction side surface 12, and in an upstream direction of the outer working fluid flow around the leading edge member 1. Channel 33*b* tangentially adjoins into channels 34 and 36, which both extend in a spanwise direction of the leading edge member 1, and are provided inside the wall in an upstream area of the suction side. Through channel 33*b*, channel 33*a* is in fluid communication with cyclone channels or spanwise extending channels 34 and 36. Again, just like in channels 21 and 31, vortex or cyclone flows 134 and 136 develop inside spanwise extending channels 34 and 36, which effectively cool the wall. Discharge channel 35 is provided in fluid communication with spanwise extending channel 34, and opens out onto the outer surface of the wall on the suction side. Discharge channel 35 is inclined with respect to the flow direction of a working fluid flow around the leading edge member 1 such that a discharge flow 135 is inclined towards the downstream direction and is thus discharged as a film cooling fluid on the suction side outer surface 12. While channels 33*a* and 33*b* extend as near wall cooling channels inside the wall underneath the outer surface of member 1, a fluid flow 133 is directed from spanwise extending channel 31 to spanwise extending channel 34 and 36, cools the material of the wall surrounding near wall cooling channels 33*a* and 33*b*. Cooling fluid flow 133 is thus referred to as near wall cooling fluid flow. As cooling fluid flow 133 flows from spanwise extending channel 31 two spanwise extending channels 34 and 36, and takes up heat from the wall, fluid flow 133 heats up. That is, cooling fluid flow 133 on the pressure side 11 is colder than on suction side 12. On the other hand, the skilled person will readily appreciate that generally the wall on the pressure side is thermally higher loaded than on the suction side. In that the wall on the pressure side is cooled with a lower temperature cooling fluid flow than the wall on the suction side, the temperature difference of the material between the suction side and a pressure side is reduced, and thermally induced stresses inside member 1 are accordingly reduced. On the downstream side of member 1, a spanwise extending plenum 37 is provided. Channel 33*a* discharges into spanwise extending plenum 37. Channel 33*b* is fed from spanwise extending plenum 37. As will further be appreciated in view of FIGS. 2 and 3, a multitude of near wall cooling channels 33*a* and 33*b* are disposed in the spanwise direction. Cooling fluid discharged from the multitude of pressure side near wall cooling channels 33*a* into spanwise extending plenum 37 is intermixed inside plenum 37. Thus, temperature distribution of cooling fluid entering suction side near wall cooling channels 33*b* is largely evened out.

Figure 2:
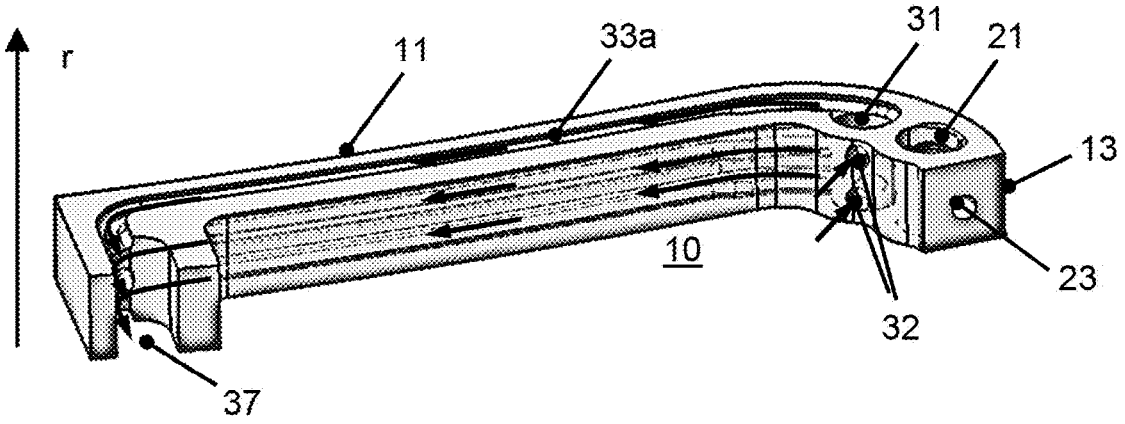
FIG. 2 a perspective view of the pressure side section of a part of the leading edge member.
Figure 3:
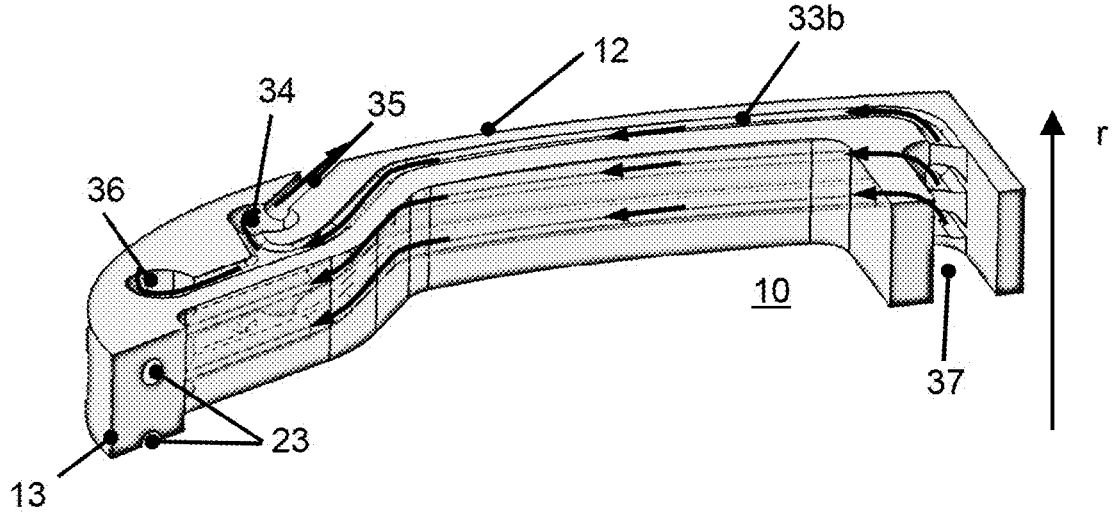
FIG. 3 a perspective view of the suction side section of a part of the leading edge member.

FIG. 2 shows in a sectional view a pressure side section of a wall of the leading edge member of FIG. 1. FIG. 3 shows in a sectional view a suction side section of a wall of the leading edge member of FIG. 1. Arrow r denotes the spanwise direction. It is seen that channels 21, 31, 34 and 36 extend with their longitudinal extent in the spanwise direction. Further, spanwise extending plenum 37 extends in the spanwise direction It is furthermore visible that a multitude of feed channels and discharge channels, and a multitude of near wall cooling channels, is disposed in the spanwise direction. A distance between neighboring near wall cooling channels in the spanwise direction may for a non-limiting instance be in a range from 4 through 5 millimeters.

It is appreciated that the wall of the component is provided with a fairly complex inner configuration of channels. While these may be manufactured by precision casting methods, it is in particular proposed to manufacture a mechanical component as herein disclosed by additive manufacturing techniques, such as those known as, but not limited to, Selective Laser Melting (SLM) or Electron Beam Melting (EBM). It is further appreciated that in principle the component may also be an entire airfoil or blading member. However, it might be found advantageous to manufacture only selected sections of an engine component by an additive manufacturing technique, and subsequently joining it with other sub-components to a functional component assembly. Thus, each section of an engine component may be manufactured by a technically and economically feasible manufacturing technique.

In an exemplary embodiment, the component is a leading edge member of a stationary vane. This facilitates securing the leading edge member to the airfoil body, as the interface is not subjected to centrifugal forces. It is understood that the application to running blades is also feasible; however, the connection at the interface needs to withstand the accordingly acting centrifugal forces.

While the subject matter of the disclosure has been explained by means of exemplary embodiments, it is understood that these are in no way intended to limit the scope of the claimed invention. It will be appreciated that the claims cover embodiments not explicitly shown or disclosed herein, and embodiments deviating from those disclosed in the exemplary modes of carrying out the teaching of the present disclosure will still be covered by the claims.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A mechanical component comprising an internal hollow space and a wall, the wall limiting the hollow space, the mechanical component further comprising:

a first channel extending inside the wall along a first direction and along a stagnation point of the wall in the first direction;

a second channel extending inside the wall and provided in fluid communication with the internal hollow space and the first channel, and intended to serve as a feed channel, wherein a cross-sectional dimension of the first channel is larger than a cross-sectional dimension of the feed channel, and the feed channel is arranged to tangentially join into the first channel, creating a first cyclone flow of a coolant fluid inside the first channel;

a third channel extending inside and along a near wall of the wall and in fluid communication with the first channel, characterized in that at least one of the second channel and/or the third channel extends inside the near wall and parallel to a surface of the near wall in a second direction forming a near wall cooling channel;

a plenum inside an interface of the wall opposite the stagnation point receiving the third channel;

a fourth channel in fluid communication with and extending from the plenum inside a far wall of the wall in a third direction opposite the second direction and in fluid communication with a fifth channel; and a sixth channel tangentially extending from the fifth channel to an exterior surface of the far wall forming a discharge channel and creating a second cyclone flow in the fifth channel.

2. The mechanical component according to claim 1, characterized in that a surface of the wall constitutes an outer surface of the component.

3. The mechanical component according to claim 1, characterized in that the surface to which the third channel extends parallel is an outer surface of the component.

4. The mechanical component according to claim 1, characterized in that the length along which the near wall cooling channel extends inside the wall and parallel to the surface of the wall is at least ten times the hydraulic diameter of the near wall cooling channel.

5. The mechanical component according to claim 1, characterized in that the fourth channel extends inside the wall and in the first direction, wherein the fourth channel is in fluid communication with the third channel through an inlet which tangentially joins into the fourth channel, and wherein a cross sectional dimension of the fourth channel is larger than a cross sectional dimension of the inlet.

6. The mechanical component according to claim 1, characterized in that the first channel is closed at its axial ends in its lengthwise orientation.

7. The mechanical component according to claim 1, characterized in that along a longitudinal extent of the first channel a multitude of at least two feed channels join into the first channel and/or at least two third channels are provided in fluid communication with the first channel.

8. The mechanical component according to claim 7, characterized in that the mechanical component is one of a turboengine blading member, an airfoil, and a leading edge member of the airfoil and exhibits at least a part of an airfoil profile, comprising a pressure side contour, a suction side contour, and a stagnation point provided therebetween, wherein the channels are provided inside a wall of the airfoil, and the first channel extends along a spanwise direction (r) of the airfoil.

9. The mechanical component according to claim 8, characterized in that at least one third channel extends from the first channel and inside a wall on the pressure side contour of the airfoil profile.

10. The mechanical component according to claim 8, wherein the leading edge member of the airfoil comprises an interface for attaching the leading edge member to an airfoil body.

11. A turboengine blading member, comprising a root, an airfoil body, and an airfoil leading edge member, characterized in that the airfoil leading edge member is a separately manufactured mechanical component according to claim 1, and is attached to the airfoil body, wherein further an open end of an inner hollow space points towards the root and is in fluid communication with an aperture in the root.

12. A method for cooling a mechanical component, the method comprising:

providing a first channel inside a wall of the component at a stagnation point;

tangentially feeding in a first direction a coolant fluid into the first channel through a second channel, thus generating a first cyclone flow of the coolant fluid inside the first channel;

discharging the coolant fluid from the first channel into a third channel, wherein the third channel extends inside a near wall of the wall and beneath a thermally loaded surface of the wall in a second direction such that the coolant fluid discharged from the first channel forms as a near wall coolant channel;

receiving the coolant fluid in a plenum inside an interface of the wall opposite the stagnation point receiving the third channel;

receiving the coolant fluid in a fourth channel in fluid communication with and extending from the plenum inside a far wall of the wall in a third direction opposite the second direction and in fluid communication with a fifth channel; and receiving the coolant fluid in a sixth channel tangentially extending from the fifth channel to an exterior surface of the far wall forming a discharge channel and creating a second cyclone flow in the fifth channel.

* * * * *